US006153056A

United States Patent [19]

Schiel

[11] Patent Number: 6,153,056

[45] Date of Patent: Nov. 28, 2000

[54] DEVICE AND METHOD FOR DRAINING A PAPER MACHINE FELT

[75] Inventor: Christian Schiel, Murnau, Germany

[73] Assignee: Voith Sulzer Papiertechnik Patent GmbH, Ravensburg, Germany

[21] Appl. No.: 09/106,458

[22] Filed: Jun. 30, 1998

[30] Foreign Application Priority Data

Jun. 30, 1997 [DE] Germany ..... 197 27 522

[51] Int. Cl.[7] ..... D21F 7/12; D21F 1/32

[52] U.S. Cl. ..... 162/199; 162/275; 162/279; 162/358.1

[58] Field of Search ..... 162/199, 275, 162/277, 278, 279, 358.1

[56] References Cited

U.S. PATENT DOCUMENTS

| | | | |
|---|---|---|---|
| 3,198,693 | 8/1965 | Justus | 162/272 |
| 3,347,740 | 10/1967 | Goumeniouk | 162/199 |
| 3,652,389 | 3/1972 | Helland | 162/275 |
| 4,116,762 | 9/1978 | Gardiner | 162/275 |
| 4,154,648 | 5/1979 | Osterberg et al. | 162/275 |
| 4,270,978 | 6/1981 | Fioravanti | 162/199 |
| 4,698,134 | 10/1987 | Green et al. | 162/199 |
| 5,958,190 | 9/1999 | Gregersen et al. | 162/275 |

FOREIGN PATENT DOCUMENTS 2055409 3/1981 United Kingdom .

*Primary Examiner*—Karen M. Hastings
*Attorney, Agent, or Firm*—Greenblum & Bernstein, P.L.C.

[57] ABSTRACT

Draining device and method for draining water from an interior surface of a felt belt loop circulating in a run direction via centrifugal force at a region of convex curvature of the interior surface of the felt belt. The draining device includes jets positioned across a width of the felt belt adapted to blast one of a displacing material and a displacing fluid against the felt belt at a position of one of in and in front of the convex region with respect to the run direction. The method includes directing jets of one of displacing fluid and displacing material against the interior surface of the felt belt to displace the water in the interior surface of the felt belt, and centrifugally spinning the displaced water out of the interior surface of the felt belt into a collecting device located within the felt belt loop.

31 Claims, 7 Drawing Sheets

DEVICE AND METHOD FOR DRAINING A PAPER MACHINE FELT

CROSS-REFERENCE TO RELATED APPLICATIONS

The present application claims priority under 35 U.S.C. § 119 of German Patent Application No. 197 27 522.2, filed on Jun. 30, 1997, the disclosure of which is expressly incorporated by reference herein in its entirety.

BACKGROUND OF THE INVENTION

1. Field of the Invention

The present invention relates to a device for draining a paper machine felt, and in particular, from an interior side of a circulating felt belt, via centrifugal force at a region of convex curvature of the felt interior side. A paper machine felt of this type is an endless felt belt that supports a fibrous pulp sheet in a press section of a paper machine and that absorbs fluid or moisture from the fibrous pulp sheet in the press zone.

2. Discussion of Background Information

Outside the press zone, felts similar to the one generally described above, tend to transfer water back to the fibrous pulp sheet, which results in an undesirable re-moistening of the fibrous pulp sheet.

Known paper machine felts are constructed in a double-sided manner having a dense, fibrous web on a paper side and a coarse support side with void spaces and openings, e.g., a synthetic material screen, on the opposite (interior) side. With this felt construction, water may be spun off at high speeds in a centrifugal force field. The felt may be guided into this centrifugal force field by placing the coarse interior side on a convex track. The water to be spun off is stored in the void spaces, and is caught in a catch trough located in the interior of the felt loop. The spin off process only starts at a velocity in which the centrifugal force surpasses the felt's ability to retain the water, which is based upon surface tension forces.

Even if the fiber web is manufactured with such high density that air cannot easily pass therethrough, preconditions for water spin-off are still not met because no air can pass between the fiber web and the water layer. Protruding water, which sucks water from the web mesh due to surface tension and initiates a convection movement, develops slowly on the surface and results in an exchange of water and air in the support layer of the felt. Due to shortness of most interior convex looping zones in the run direction of a paper machine felt and due to an initial time delay during which the convection effect is produced, only a limited amount of water can be spun off.

SUMMARY OF THE INVENTION

The present invention avoids the above-noted deficiency of the prior art, and enables the spin-off of larger amounts of water, even at relatively low run speeds.

The present invention provides that the water surface in the screen web is made wavy by blasting a plurality of streams or jets of displacement material or fluid, spaced across a felt width, through the screen web prior to or when the screen web arrives at a convex deflection zone. The waves are created by the force of the injected displacement fluid stream or jet compressing a fluid level in impact zones. In this manner, the water displacement at these locations lead to an enlargement of the water film in pores located between the blast jets. Thus, a controlled convection motion is initiated and protuberances are created in the enlarged areas to suck in more water and spin it off. Water or air may be utilized as the displacement material or fluid. Depending on the conditions, one or the other may be more advantageous.

A most favorable distance between adjacent jet streams in a direction across the machine is, e.g., approximately 2 to 12 mm. A most favorable distance of the jets to the felt surface is, e.g., less than approximately 20 mm. The blast pipe, also referred to as a jet pipe, may be equipped with a plurality of jets, and may be equipped with a guide shoe or a guide surface that is lightly pressed onto the felt to make contact over an entire width of the felt to maintain a constant distance of the jets from the felt surface across the width of the felt. This contact pressure, of course, is only necessary if the felt is not yet supported on the opposite side in the contact pressure region.

Instead of a blast pipe, it is also advantageous to utilize a so-called "rinse-blast" device, which includes at least one support element that is coupled to an air supply opening and includes openings, e.g., in the form of slits or through-openings, to influence the felt surface. The rinse-blast unit preferably includes a coated, box-shaped support body having a surface that provides the contact area with the felt and includes openings in the form of blast slits for supplying the displacement fluid for blasting the felt. The air supply opening, preferably side-mounted on the support element, is preferably coupled to the blast slits formed in the coating via a through-opening. A plurality of blast slits are preferably coupled to a through-opening. In the vertical direction, the through-openings can be formed in different ways with respect to their cross sectional assembly position. The blast air reaches the blast slits through the air supply opening and the through-opening to inject air between planks created by cross-grooves and the porous interior side of the felt. The cross grooves are also provided on the rinse-blast device and are open to the atmosphere.

The coating may preferably be manufactured in the form of a shoe and made of wear-resistant material, e.g., polyethylene. The coating may be preferably curved in a direction of the felt belt to ensure optimal contact with the surface of the rinse-blast device.

The draining device can, in order to intensify the draining process using centrifugal force, be combined with other draining devices. In this manner, the paper dry content may be increased and energy usage may be reduced. It may also be advantageous to drain other portions of the fluid from the felt belt, not by the spinning process by centrifugal force, but by using scraper units and/or devices for creating a vacuum, e.g., a suction line contacting a respective area of the felt belt or suitable foils. It is noted that the specific construction and arrangement with the other draining devices lies within the capabilities of the ordinarily skilled practitioner and generally depends on the specific requirements of the task at hand.

The present invention is directed to a draining device for draining water from an interior surface of a felt belt circulating in a run direction via centrifugal force at a region of convex curvature of the interior surface of the felt belt. The draining device includes jets positioned across a width of the felt belt adapted to blast one of a displacing material and a displacing fluid against the felt belt at a position of one of in and in front of the convex region with respect to the run direction.

In accordance with another feature of the present invention, a blast pipe extends across the width of the felt belt, and the jets are formed in the blast pipe.

In accordance with another feature of the present invention, a guide surface is mounted on the blast pipe that is adapted to support the felt.

In accordance with another feature of the present invention, a rinse-blast unit extends substantially across the width of the felt belt and the jets are formed in the rinse-blast unit. Further, the rinse-blast unit includes a box-shaped support element that is one of coated and joined with a wear-resistant coating and includes an opening for an air supply. The opening for the air supply is coupled to the jets and the jets are positioned to project from a surface of the wear-resistant coating and are adapted to point away from the box-shaped support element. Still further, the base surface of the box-shaped support element further includes openings and the wear-resistant coating includes blow slits. The jets are formed by coupling the openings in the box-shaped support element and the blow slits. The wear-resistant coating may include exhaust air slits that couple the surface of the wear-resistant coating to the atmosphere. The surface of the wear-resistant coating may be curved in the run direction.

In accordance with another feature of the present invention, the jets are spaced a distance of approximately 2 to 12 mm from each other.

In accordance with another feature of the present invention, a discharge point of the jets is spaced approximately 3 to 15 mm from the felt belt.

In accordance with another feature of the present invention, additional devices are located one of within and immediately after the region of convex curvature, relative to the run direction. The additional devices are adapted to drain water from the interior side of the felt belt. Further, the additional devices include at least one scraper rail coupled to the interior surface of the felt belt. Further, the additional devices include a vacuum located on the interior surface of the felt belt.

The present invention is directed to a press section of a paper machine having at least two press rolls forming a press zone. The press section includes at least one press roll positioned inside an endless felt belt that is guided by a plurality of guide rolls, an interior surface of the endless felt belt having a convex curvature around at least one of the guide rolls, and jets positioned across a width of the endless felt belt that are adapted to blast one of a displacing material and a displacing fluid against the felt belt at a position of one of in and in front of the convex region with respect to a run direction.

In accordance with another feature of the present invention, a traversing needle pipe is located downstream from the jets in the run direction and is adapted to direct a cleaning jet substantially perpendicular to the interior surface.

In accordance with another feature of the present invention, a transverse rail having an end coupled to the interior surface of the felt belt at a take-off region of the at least one guide roll is provided.

In accordance with another feature of the present invention, a vacuum is formed downstream of the jets to suction the interior surface of the felt belt. Further, the vacuum is formed by a gusset formed between a scraper and the interior surface of the felt belt, and an end of the scraper is positioned against the interior surface of the felt belt at a position adjacent a take-off point of the felt belt from the at least one guide roll.

In accordance with another feature of the present invention, a rinse-blast unit is provided for forming the jets. The rinse-blast unit includes a container having a coated surface adapted to be positioned to face the interior surface of the felt belt. The coated surface includes at least one opening coupled to at least one blow slit, and the container has an opening coupled to the opening of the coated surface. Further, the container is coupled to an air supply. The blow slits have an arcuate shape that extends substantially in the run direction. Alternatively, the blow slits have an arcuate shape that extends obliquely to the run direction, e.g., the blow slits extend at an angle of less than approximately 2° from the run direction.

In accordance with another feature of the present invention, the coated surface includes grooves positioned between the blow slits that extend through the coated surface. Further, the grooves are adapted to couple the blow slits with the outside atmosphere.

The present invention is also directed to a method for draining water from an interior surface of a felt belt. The method includes directing jets of one of displacing fluid and displacing material against the interior surface of the felt belt to displace the water in the interior surface of the felt belt, and centrifugally spinning the displaced water out of the interior surface of the felt belt.

In accordance with another feature of the present invention, the centrifugal spinning includes guiding an outer surface of the felt belt around guide roll in a run direction to form a region of convex curvature in the interior surface, and the jets are directed against the interior surface at one of a position at and ahead of the guide roll relative to the run direction.

In accordance with another feature of the present invention, the method further includes substantially equally spacing the jets transversely across the felt belt, and maintaining a substantially constant distance between the jets and the interior surface of the felt belt.

In accordance with another feature of the present invention, the method further includes directing a cleaning jet substantially perpendicular to the interior surface of the felt belt in a region in which the water is centrifugally spun out of the interior surface.

In accordance with another feature of the present invention, the method further including positioning a scraping device to scrape excess water from the interior surface of the felt belt after the centrifugal spinning.

In accordance with another feature of the present invention, the method further including creating a vacuum to suction excess water from the interior surface after the centrifugal spinning.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
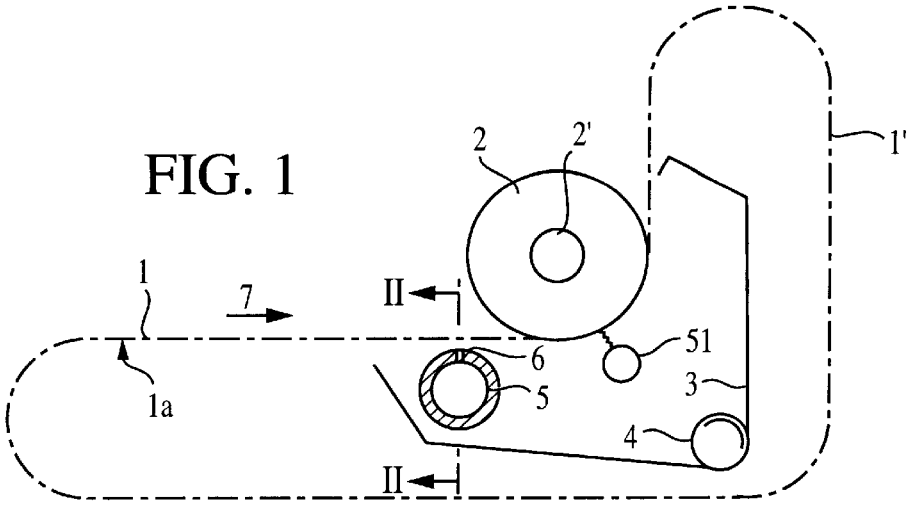
FIG. 1 illustrates an arrangement of a nozzle/jet pipe in a felt loop.

In FIG. 1, a felt 1 is guided in a run direction indicated by arrow 7 to loop around an outer guide roll 2 that is rotatably positioned on a yoke or carrier 2'. The dash-dotted line 1' schematically illustrates that felt 1 is an endless belt, however, the path of felt 1 may be arbitrarily selected. This arrangement may also include other elements commonly utilized in wet press units for influencing felt 1. For example, because water is to be spun from a periphery of felt 1 in the vicinity of guide roll 2, a catch trough 3 may be positioned to stretch across an entire width of the felt and is carried out of the felt loop via a side-mounted drain 4. Shortly before felt 1 is placed onto roll 2, a displacing fluid, originating from a blast pipe 5, is blasted or injected against the interior side of the felt with a large number of Jets 6 which are spaced across the width of the felt.

Further, a needle jet unit may be provided to keep an interior side 1*a* of felt 1 clean. The needle jet unit may be formed, e.g., as a traversing needle jet pipe 51. In this manner, needle jet pipe 51 may be mounted on a stand to be oriented substantially perpendicular to the felt run direction and the stand may by adjustably positionable relative to felt 1 or to interior side 1*a*. Traversing needle jet pipe 51 may be positioned behind or after jets 6 in felt run direction 7. In the exemplary illustration, needle jet pipe 51 may be directed toward the outer guide roll 2 in the guide roll spooling area after felt 1 has spooled onto outer guide roll 2. Alternatively, it is also possible to position traversing needle jet pipe 51 in an effective area of jets 6 on interior side 1*a* of felt 1 and the spooling location of felt 1 onto outer guide roll 2 (not shown).

It is also conceivable to provide a traversing needle jet pipe 51 having a freely adjustable or controlled repositioning frequency that depends upon the specific parameters of the application, e.g., speed of rotation of the felt. Further, it is also possible to utilize a plurality of needle jet units 51.

Figure 2:
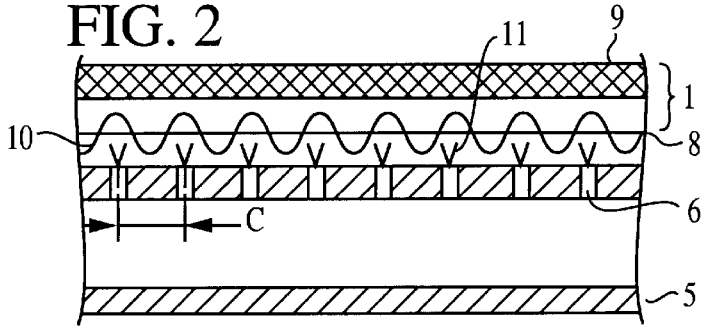
FIG. 2 illustrates a detailed cross-section of FIG. 1 as viewed through section line II—II.
Figure 3:
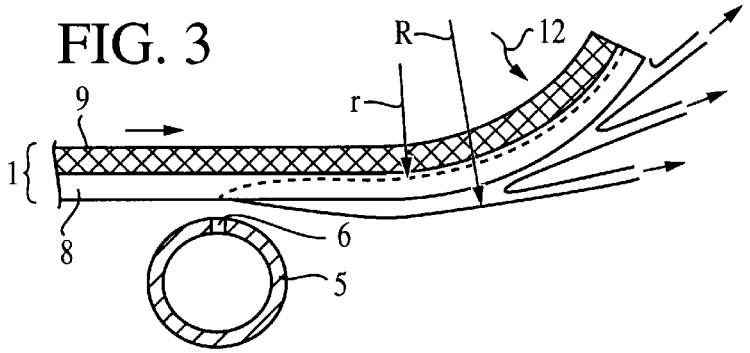
FIG. 3 illustrates a detailed longitudinal segment of FIG. 1.

In FIG. 2, felt 1, which includes a support layer 8 and a fiber web 9, is positioned over blast pipe 5 having jets 6. Due to the force or impulse of the displacing fluid injected or blasted against the underside of felt 1, water in the mesh of the web within support layer 8 is pushed upward and moved toward the sides so that the surface of water level 10 in support layer 8 exhibits an undulating or wavy pattern. As illustrated in FIG. 3, when the wavy or rippled water surface reaches curved area 12 of felt belt 1, water ripples 13, having a higher radius R and, therefore, a higher centrifugal force, pull additional water from the wavy portions that have lower centrifugal forces due to their smaller radius r. The water concentrated in ripples 13 is spun off.

Figure 4:
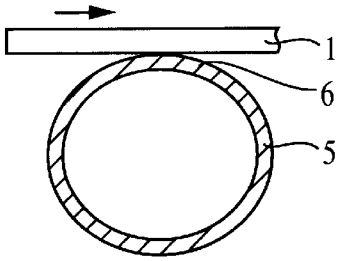
FIG. 4 illustrates a detailed longitudinal segment with a supported felt.

Blast pipe 5 may be positioned to make contact across the entire width of felt 1, as shown in FIG. 4, so that the effect created by displacing fluid is as even as possible across the entire felt width. Moreover, the distance between the openings of jets 6 and the surface of the felt 1, i.e., interior surface 1*a*, is maintained to be the same at all jet locations.

Figure 5:
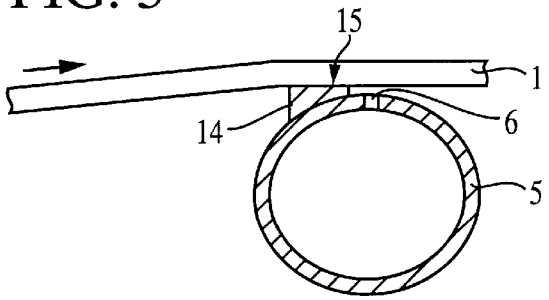
FIG. 5 illustrates a detailed longitudinal segment with a supporting rail.

In an alternative embodiment, e.g., as illustrated in FIG. 5, blast pipe 5 may be provided with a pushed-on guide shoe 14 having a guide surface that is slightly pressed into felt 1 to provide a constant opening space or distance between jets 6 and the underside of felt 1 across the width of the felt.

Figure 6:
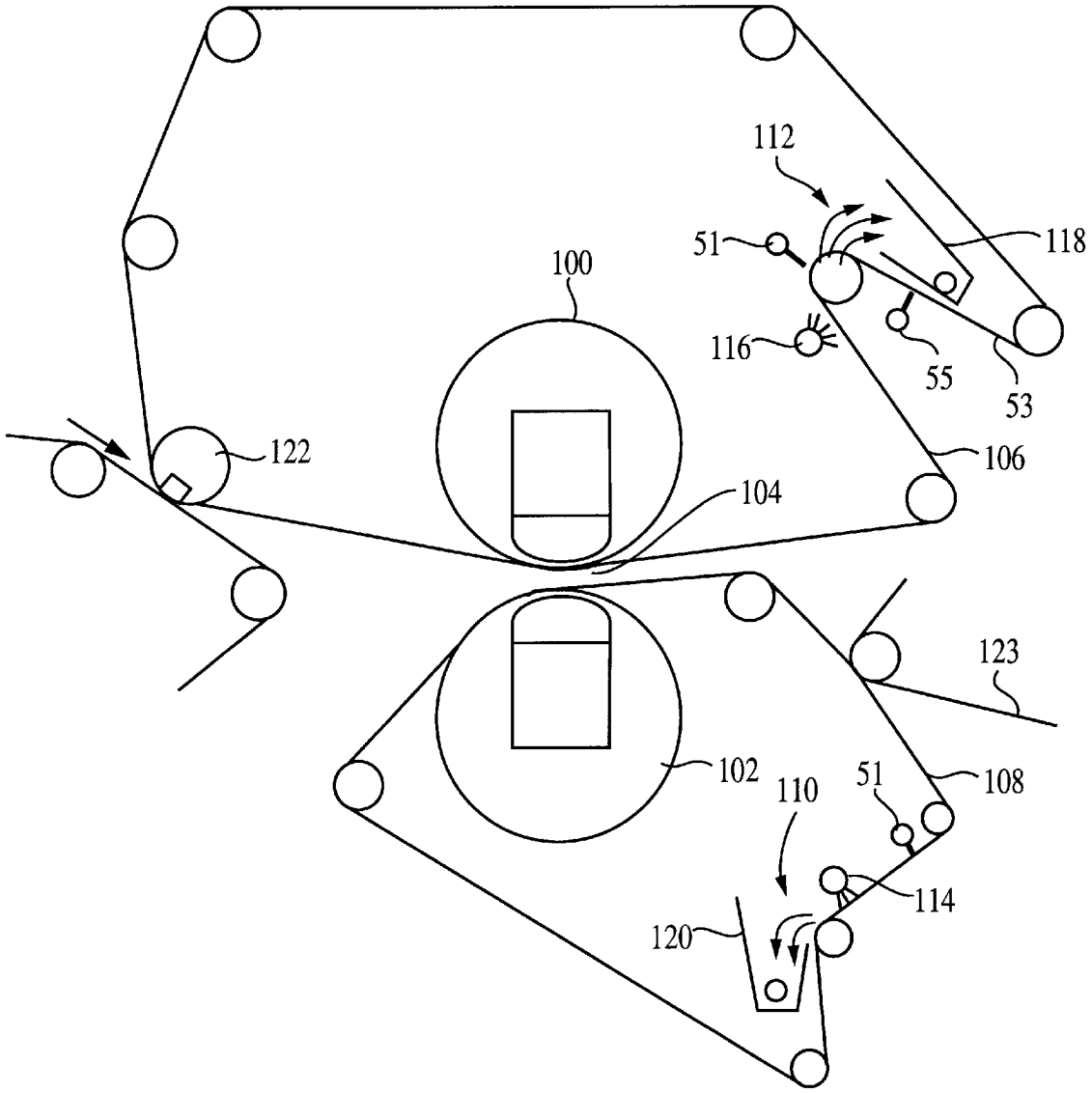
FIG. 6 illustrates the use of a draining device in accordance with the present invention in the press section of a paper machine.

FIG. 6 shows an advantageous embodiment of a press section of a paper machine in which a draining device for draining the interior side of a circulating felt belt with the aid of centrifugal force is utilized. As discussed above, displacing fluid may be blasted against the felt before the curved section which will spin off the excess water.

The press section in accordance with FIG. 6 shows two press rolls 100 and 102 that form a press zone 104. Each of the press rolls is surrounded by a circulating endless felt belt 106 and 108, e.g., a two-sided felt belt. In the press zone, a liquid, particularly water, may be transferred into the felt belt from a fibrous pulp web or sheet. Generally for felt belts of this type, a fine fiber web is positioned on a support layer having openings and void spaces.

Each of the felt belts 106 and 108 may be guided through draining devices 110 and 112 having jets 114 and 116 for applying, i.e., blasting or injecting, displacing fluid and catch troughs 118 and 120 for collecting the spun off water from the respective felts. The paper sheet runs in a direction indicated by the arrow and is transferred into the press section via a take-up roll 122. The paper sheet follows felt 108 after press zone 104 until being transferred to a belt 123 that guides the paper sheet into either other press stations or a drying section.

By using draining devices 110 and 112 having jets 114 and 116, the felt belts may be drained to a higher degree than previously available in the prior art. In this manner, it is possible to use draining devices 110 and 112 instead of devices positioned directly on press rolls 100 and 102 that are designed to remove fluid. Further, it is also possible to achieve even better draining results of felt 1, i.e., results that were not previously attainable, via a combination of these devices.

Figure 7:
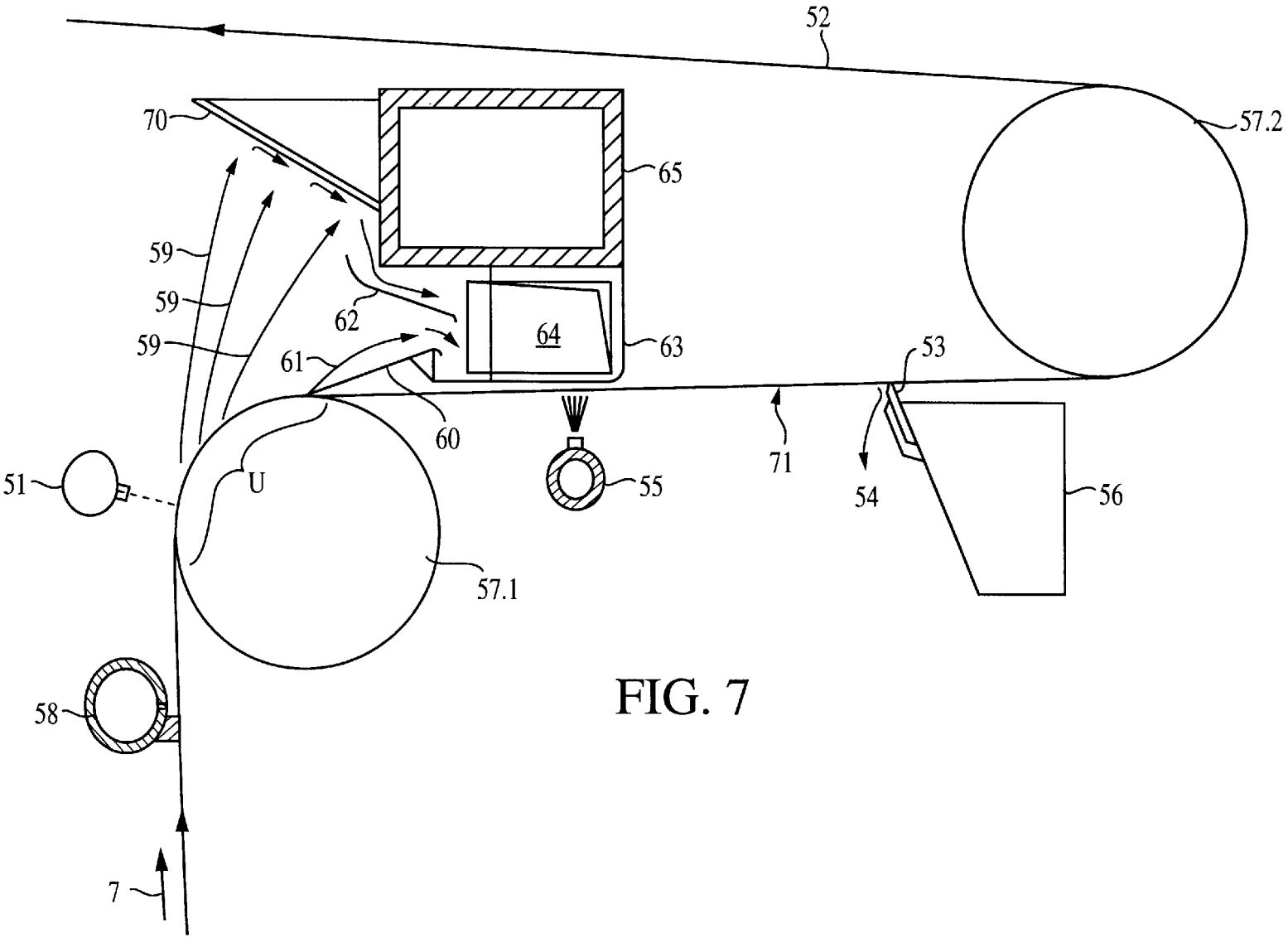
FIG. 7 illustrates the arrangement of the nozzle pipe in the felt loop in combination with additional water-scraping devices.

FIG. 7 illustrates another embodiment of a draining device for removing water from an interior side of a circulating felt 52 by centrifugal force. The illustration shows a portion of a press section where felt 52 is blasted with a displacing material or fluid before it reaches a curved region U around outer guide roll 57.1. Felt 52 may be guided over a plurality of guide rolls including, e.g., guide rolls 57.1 and 57.2, in a felt run direction 7. A jet pipe 58 is provided to create an undulating or wavy motion of the water on the surface in the backing fabric, i.e., support layer, of felt 52. Jet pipe 58 may be positioned in front of, i.e., in run direction 7, an area in which felt 52 is spooled onto guide roll 57.1. The water in the backing fabric of felt 52 is rippled at its surface by jet pipe 58, and, as depicted in the exemplary illustration, is removed in two ways. A first (spun-off) portion of the water is removed via centrifugal force in the spooling area of felt 52 around guide roll 57.1, i.e., curved region U. The removed water, i.e., spun off, from felt 52 is schematically depicted as arrows 59. A second portion is wiped off using a scraper device 60 in the form of, e.g., a transverse rail/scraper 60 that stretches across an entire width of felt belt 52. A scraping end of scraper 60 may be positioned in an area in which felt belt 52 winds off guide roll 57.1. The removed water, i.e., scraped, from felt 52 is schematically depicted as arrow 61. For example, the water spun off in area 59 may be diverted via a deflector surface 70 to a guide sheet 62, and from guide sheet 62 to a catch groove 63 that advantageously includes a side-mounted drain 64. The water wiped or scraped off via scraper 60 may also be guided into catch groove 63 along guide sheet 62. Groove 63, scraper 60, deflector surface 70, and guide surface 62 may be mounted on a cross beam 65 that stretches across the entire width of felt 52. Further, deflector surface 70, guide sheet 62, scraper 60, and catch groove 63 may be arranged in a run direction of the felt 7 so that water is also removed in run direction 7 of felt 52.

Further, instead of a vacuum pipe, a transverse rail in the form of a scraper 53 may be provided for cleaning felt 52 by scraping dirt off the felt exterior surface 71. The removed dirt may be schematically depicted as arrow 54. The dirt may also be dissolved or loosened via a moisturizing jet nozzle 55, also known as a "duo-cleaner." Moisturizing jet nozzle 55 may be positioned ahead of 7. Scraper 53 may be mounted on a height-adjustable cross-carrier 56 that substantially extends across the width of felt 52. Cleaning jet nozzle 51 may be positioned to clean the interior surface or side of felt 52 across the width using several streams.

Figure 8:
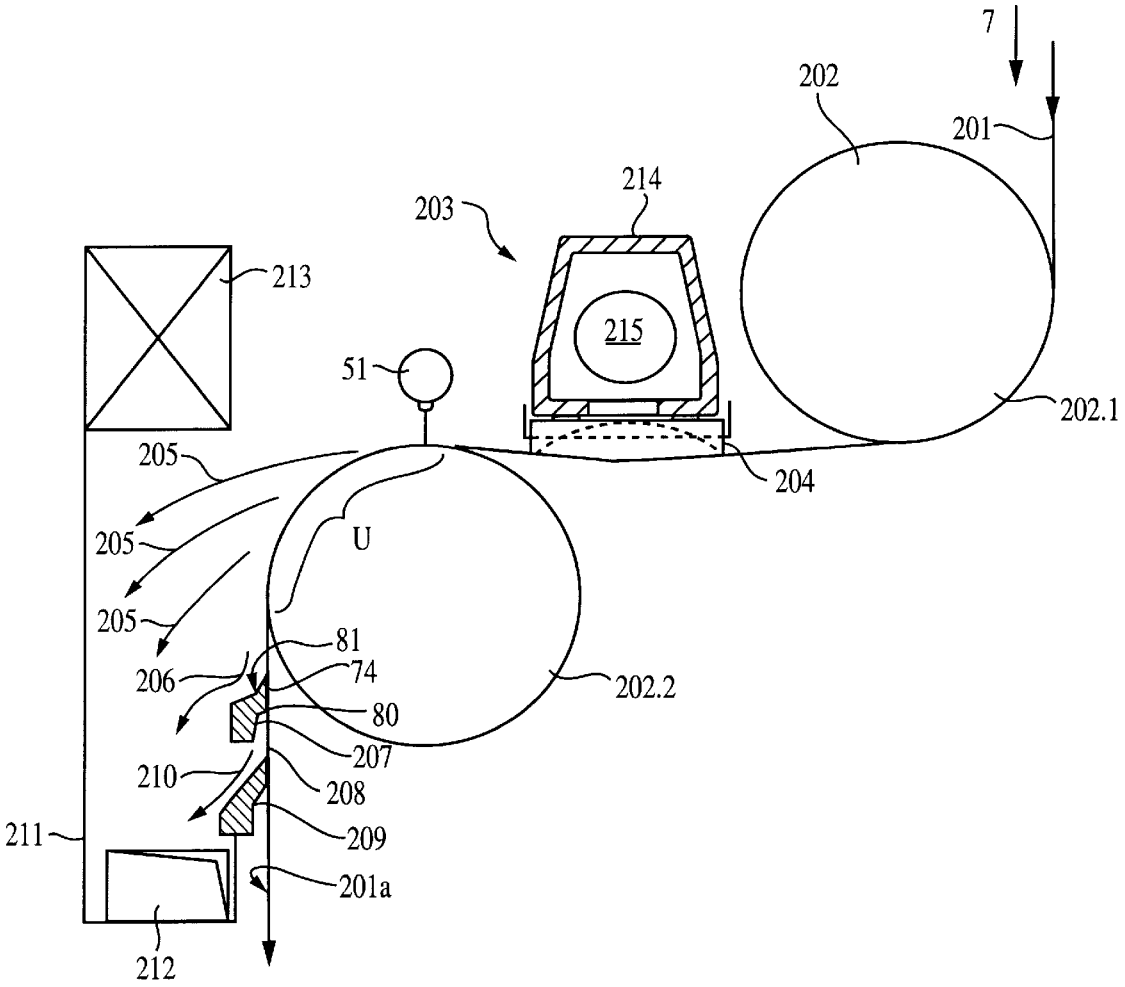
FIG. 8 illustrates the arrangement of a rinse-blast device in a felt loop to increase the intensity of the draining process and a combination with additional scraping and vacuuming devices to intensify the draining process.

FIG. 8 illustrates another embodiment of a draining device in accordance with the present invention within a press section. Felt 201 may be guided over a plurality of guide rolls including, e.g., guide rolls 202.1 and 202.2 in a run direction 7. In this embodiment, a rinse-blast device 203 may be utilized in place of a jet pipe. The specific construction assembly and the function of rinse-blast device 203 will be described in further detail below with reference to FIGS. 9 to 11. Rinse-blast device 203 includes a support body 214, advantageously shaped in the form of a box, that is coupled to or coated with a wear-resistant element, such as a shoe 204 made of, e.g., polyethylene, that substantially extends transversely across interior side 201*a* of felt 201. Rinse-blast device 203 may be advantageously pressed onto felt 201 via shoe 204 in front of guide roll 202.2, where draining, or spinning off, of moisture is to occur. Rinse-blast device 203 may also include an air supply opening 215, e.g., side mounted, through which air may be blasted or injected, e.g., at a pressure of approximately 1 to 5 kPa.

Rinse-blast device 203 may be alternatively utilized in place of blast pipes 5 in FIGS. 1 to 6 and blast pipes 58 in FIG. 7 to create a wavy surface in the water in the interior surface of the felt belt, however, with a different intensity level. In the spooling area U of guide roll 202.2, a first portion of water, schematically depicted as arrows 205, is spun out of felt 201 due to centrifugal force, and a second portion of water, schematically depicted as arrow 206, is removed at a location substantially adjacent to a wind-off point of felt 201 from guide roll 202.2, i.e., outside of spooling area U, by being scraped off via a leading edge of a transverse-rail/scraper 207. Transverse-rail/scraper 207 may be positioned against interior side 201*a* of felt 201 in an effective area 74 to form a foil gusset 208 between a back side 80 of transverse-rail/scraper 207 and felt belt 201. Within foil gusset 208, water is sucked out of the felt 201 via a vacuum. The water, schematically depicted as arrow 210, may be diverted by a transverse-rail/scraper 209 and fed to a catch groove 211. Catch groove 211 may advantageously include a side-mounted drain 212 and may be mounted on a cross-beam 213.

In the exemplary illustration, water 206 may be scraped from the felt surface 201*a* by positioning transverse-rail/scraper 207 at an angle relative to felt belt 201 and may be diverted to be collected in a catch groove 211 via a deflector surface 81. The suction effect created by the angled orientation of transverse-rail/scraper 207 in foil gusset 208 is also utilized. In this manner, three different draining concepts may be utilized, i.e., spin-off by centrifugal force, scraping by transverse-rail/scraper 207, and suction effect in area 208. Thus, more than simply the draining concept of creating wave motion in the water surface by blasting a plurality of jets of displacing material or fluid across the felt width in front of, or in, the convex deflection zone may be utilized to remove as much fluid from the felt as possible.

It is further possible to position needle jet pipe 51 behind rinse-blast device 203 and in front the draining locations created by the centrifugal force at guide roll 202.2. Thus, needle jet pipe 51 provides a cleaning function.

Figure 9:
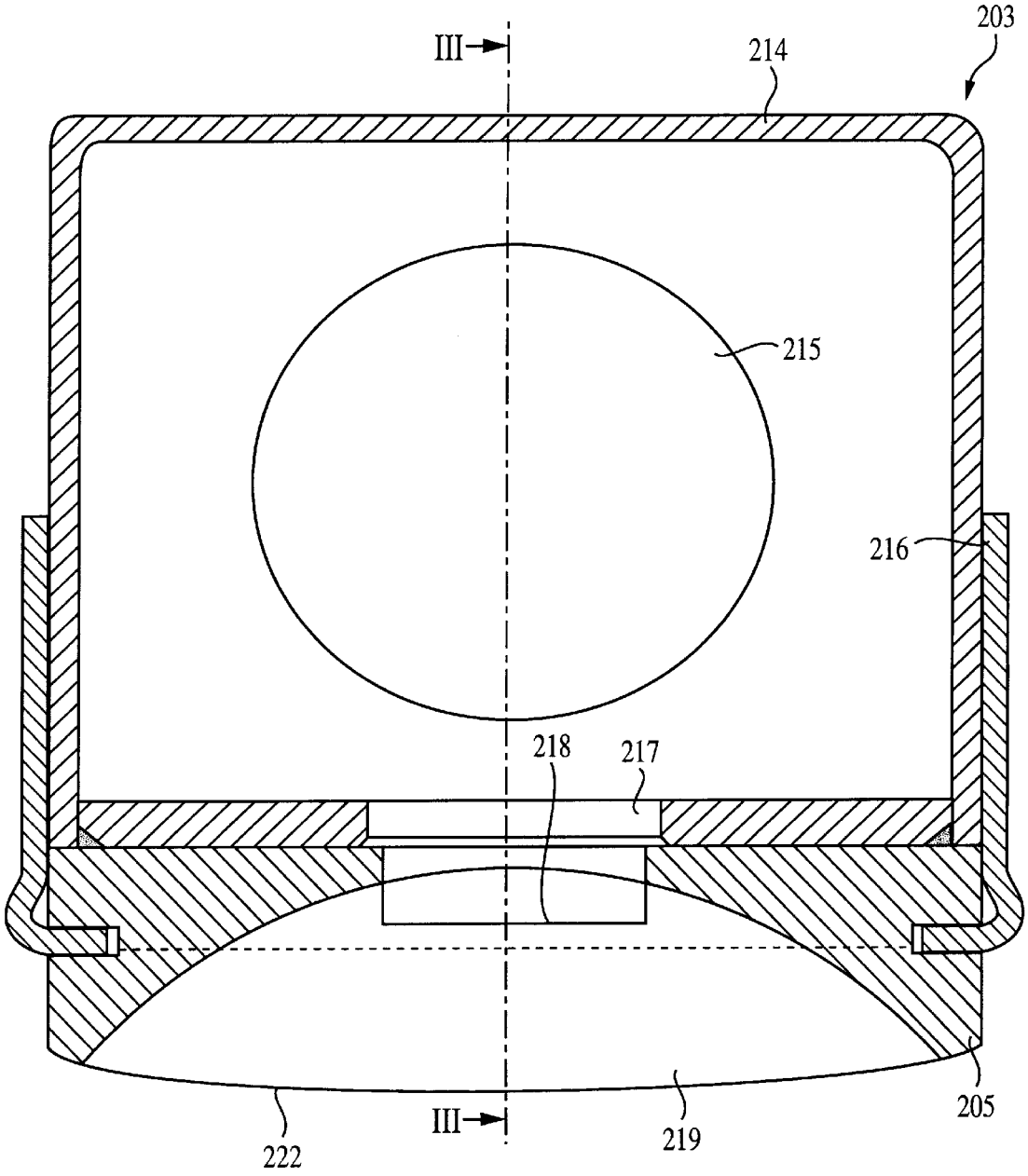
FIG. 9 illustrates the rinse-blast device in a cross-sectional view.
Figure 10:
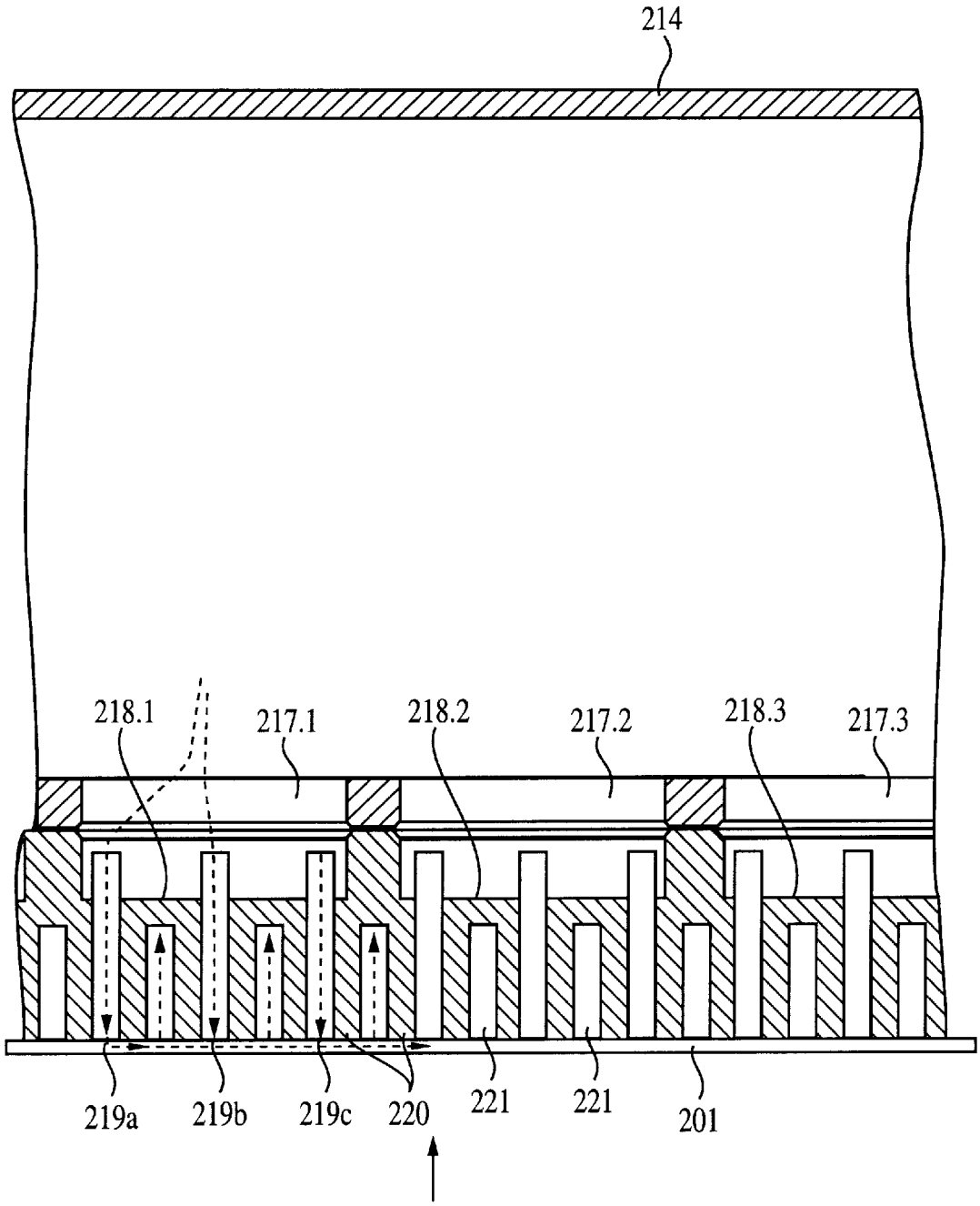
FIG. 10 illustrates a cross section of FIG. 9 as viewed through section line III—III.
Figure 11:
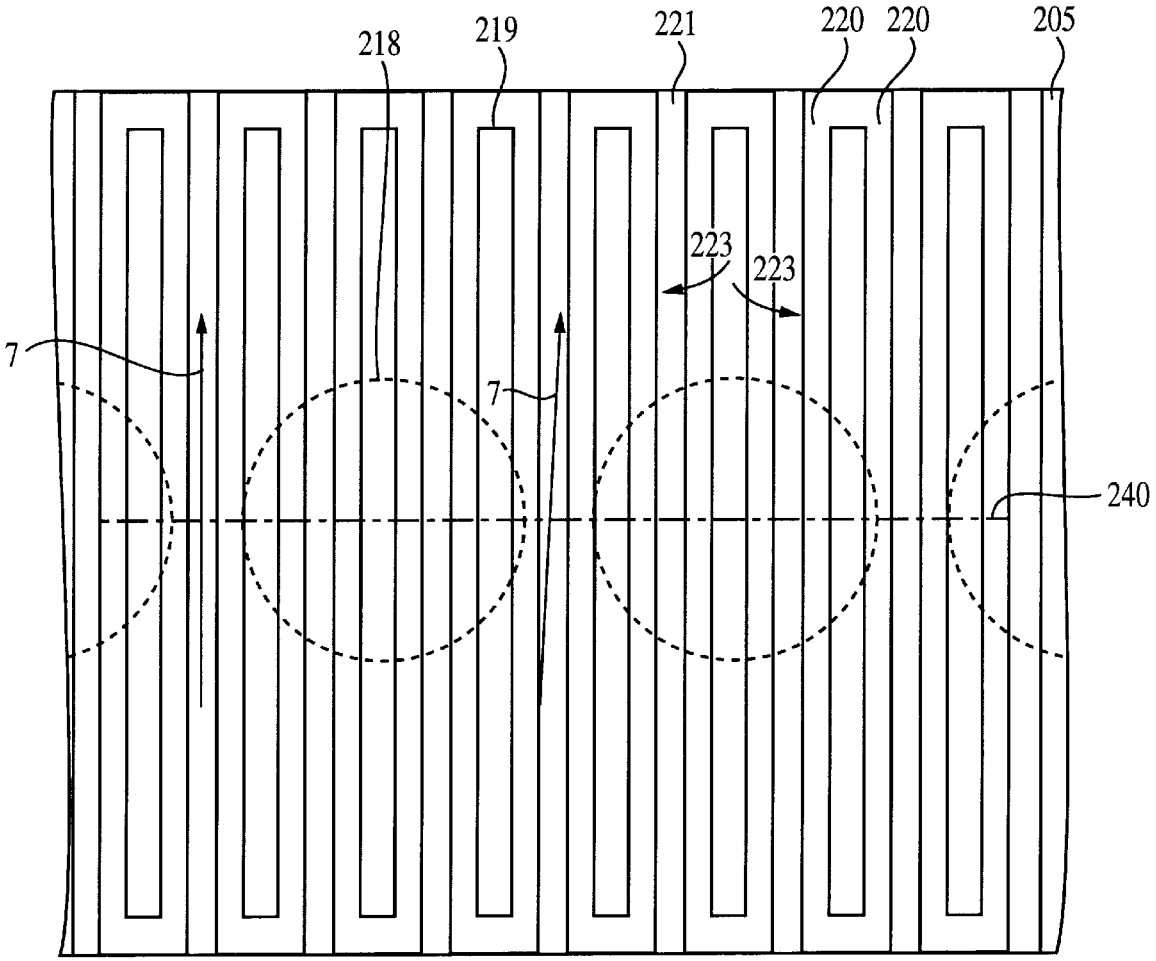
FIG. 11 illustrates a bottom view of FIG. 10.

Rinse-blast device 203, used in accordance with an alternative embodiment of the present invention, is depicted in greater detail in FIGS. 9–11. These figures show a support element 214 that is coupled to or coated with, e.g., a polyethylene coating and a polyethylene shoe. Polyethylene shoe 205 includes a surface 222 that advantageously extends into or presses against the felt surface, particularly, the interior surface of the felt. Surface 222 may be formed, e.g., as a curved surface extending in the run direction of the felt to enlarge the effective surface 222 and to achieve optimal contact between the felt belt and the surface 222 of the polyethylene shoe 205. Then, as a result of longitudinal tension, the felt makes direct contact with surface 222. The coupling between box-shaped support element 214 and the coating can be provided, e.g., via a clamping unit 216. The blast air is fed via air supply opening 215 to openings 217 that are located in a bottom of box-shaped support element 214, i.e., directed toward the felt. The blast air is further fed to through-openings 218 in coating 205, e.g., formed as pocket holes 218, coupled to blast slits 219 extending between through-openings 218 and surface 222. Numerous possibilities exist with respect to the construction of the blast slits and the coupling between the box-shaped support element 214, and, in particular, between air supply opening 215 and blast slits 219. The specific manner of construction lies within the capabilities of the ordinarily skilled artisan and is dependent upon the application.

In the exemplary illustration, the coupling is realized via through-openings and slits. A plurality of blast slits 219 are advantageously coupled to opening 217 or through-opening 218. For example, FIG. 10 depicts a view along section line III—III of FIG. 9 in which three blast slits 219*a*, 219*b*, and 219*c* extend into pocket hole 218.1 which is coupled to opening 217.1 in box-shaped support element 214. In this manner, it is seen that the air supplied via air supply openings 215 and fed through opening 217, pocket hole 218, and blast slits 219 is guided under planks 220, through the porous interior layer of felt 201, and into longitudinal grooves 221 that are open to the atmosphere. As arrows 223 of FIG. 11 illustrate, the fluid is blasted from the support layer or backing fabric of felt 201 at the locations of blast slits 219 and from planks 220 in the region of open grooves 221, so that fluid may be spun off more easily in a concentrated area U along the circumference of guide roll 202.2 (FIG. 8).

Slits 219 may advantageously include a semi-circular cross-section in accordance with the exemplary side view of FIG. 9 and a rectangular cross-section in accordance with the exemplary top view of FIG. 11.

The specific combination of draining devices in accordance with the present invention for intensifying the draining, e.g., scraping or wipe-off devices, vacuums, etc., depends upon the specific requirements of each individual case.

The run direction 7 of the felt in FIG. 11 may be parallel to slits 219 and 221 or, as depicted by arrow 7', may be slightly inclined to slits 219 and 221. The angle of inclination is preferably small, e.g., less than approximately 2°. This inclination can be achieved either by tilting the orientation of axis 240 of rinse unit 203 from perpendicular to felt run direction 7, or by orienting axis 240 perpendicular to run direction 7 and obliquely orienting slits 219 and 221 relative to run direction 7.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A draining device in combination with a felt belt for draining water from an interior surface of a felt belt circulating in a run direction via centrifugal force at a region of convex curvature of the interior surface of the felt belt comprising:

a guide roll located outside of a felt belt loop to form the region of convex curvature of the interior surface of the felt belt;

jets positioned across a width of the felt belt structured and arranged to blast one of a displacing material and a displacing fluid against the interior surface of the felt belt at a position of one of in and in front of the convex region with respect to the run direction, wherein the jets are arranged to create waves in the water to be drained; and a device for collecting centrifially spun off water which is located within the felt belt loop.

2. The draining device in accordance with claim 1, further comprising a blast pipe extending across the width of the felt belt; and the jets being formed in the blast pipe.

3. The draining device in accordance with claim 2, further comprising a guide surface mounted on the blast pipe, the guide surface being adapted to support the felt.

4. The draining device in accordance with claim 1, further comprising a rinse-blast unit that extends substantially across the width of the felt belt; and the jets being formed in the rinse-blast unit.

5. The draining device in accordance with claim 4, the rinse-blast unit comprising:

a box-shaped support element being one of coated and joined with a wear-resistant coating and including an opening for an air supply;

the opening for the air supply being coupled to the jets; and the jets positioned to project from a surface of the wear-resistant coating and adapted to point away from the box-shaped support element.

6. The draining device in accordance with claim 5, the base surface of the box-shaped support element further including openings and the wear-resistant coating including blow slits, wherein the jets are formed by a coupling of the openings in the box-shaped support element and the blow slits.

7. The draining device in accordance with claim 5, the wear-resistant coating further including exhaust air slits that couple the surface of the wear-resistant coating to the atmosphere.

8. The draining device in accordance with claim 5, the surface of the wear-resistant coating being curved in the run direction.

9. The draining device in accordance with claim 1, the jets being spaced a distance of approximately 2 to 12 mm from each other.

10. The draining device in accordance with claim 1, a discharge point of the jets being spaced approximately 3 to 15 mm from the felt belt.

11. The draining device in accordance with claim 1, further comprising additional devices located one of within and immediately after the region of convex curvature, relative to the run direction, the additional devices being adapted to drain water from the interior side of the felt belt.

12. The draining device in accordance with claim 11, the additional devices comprising at least one scraper rail coupled to the interior surface of the felt belt.

13. The draining device in accordance with claim 11, the additional devices comprising a vacuum located on the interior surface of the felt belt.

14. A press section of a paper machine having at least two press rolls forming a press zone in combination with an endless felt belt, comprising:

at least one press roll being positioned inside the endless felt belt, which is guided by a plurality of guide rolls, wherein at least one of the plurality of guide rolls is located outside of the endless felt belt;

an interior surface of the endless felt belt having a convex curvature around the at least one guide roll located outside of the endless felt belt, wherein a centrifugal force is imparted on the interior surface of the endless felt belt around the at least one guide roll for draining water from the interior surface;

jets positioned across a width of the endless felt belt structured and arranged to blast one of a displacing material and a displacing fluid against the interior surface of the felt belt at a position of one of in and in front of the convex region with respect to a run direction, wherein the jets are arranged to create waves in the water within the felt belt; and a device for collecting centifugally spun off water which is located within the felt belt loop.

15. The press section in accordance with claim 14, further comprising a traversing needle pipe located downstream from the jets in the run direction; and the traversing needle pipe adapted to direct a cleaning jet substantially perpendicular to the interior surface.

16. The press section in accordance with claim 14, further comprising a transverse rail having an end coupled to the interior surface of the felt belt at a take-off region of the at least one guide roll.

17. The press section in accordance with claim 14, further comprising a vacuum formed downstream of the jets to suction the interior surface of the felt belt.

18. The press section in accordance with claim 17, the vacuum being formed by a gusset formed between a scraper and the interior surface of the felt belt; and an end of the scraper being positioned against the interior surface of the felt belt at a position adjacent a take-off point of the felt belt from the at least one guide roll.

19. The press section in accordance with claim 14, further comprising a rinse-blast unit forming the jets, the rinse-blast unit comprising:

a container having a coated surface adapted to be positioned to face the interior surface of the felt belt;

the coated surface including at least one opening coupled to at least one blow slit; and the container having an opening coupled to the opening of the coated surface.

20. The press section in accordance with claim 19, the container being coupled to an air supply.

21. The press section in accordance with claim 19, the blow slits having an arcuate shape extending substantially in the run direction.

22. The press section in accordance with claim 19, the blow slits having an arcuate shape extending obliquely to the run direction.

23. The press section in accordance with claim 22, the blow slits extending at an angle of less than approximately 2° from the run direction.

24. The press section in accordance with claim 19, the coated surface further including grooves positioned between the blow slits that extend through the coated surface.

25. The press section in accordance with claim 24, the grooves adapted to couple the blow slits with the outside atmosphere.

26. A method for draining water from an interior surface of a felt belt loop comprising:

directing jets of one of displacing fluid and displacing material against the interior surface of the felt belt to create waves in the water in the interior surface of the felt belt, wherein the jets are spaced across a width of the interior surface; and centrifgally spinning wavy water out of the interior surface of the felt belt at a convex curvature of the interior surface of the felt belt and into a collecting device located within the felt belt loop.

27. The method in accordance with claim 26, the centirugal spinning comprising guiding an outer surface of the felt belt around guide roll in a run direction to form the region of convex curvature in the interior surface; and the jets being directed against the interior surface at one of a position at and ahead of the guide roll relative to the run direction.

28. The method in accordance with claim 26, further comprising substantially equally spacing the jets transversely across the felt belt; and maintaining a substantially constant distance between the jets and the interior surface of the felt belt.

29. The method in accordance with claim 26, further comprising directing a cleaning jet substantially perpendicular to the interior surface of the felt belt in a region in which the water is centrifugally spun out of the interior surface.

30. The method in accordance with claim 26, further comprising positioning a scraping device to scrape excess water from the interior surface of the felt belt after the centrifugal spinning.

31. The method in accordance with claim 26, further comprising creating a vacuum to suction excess water from the interior surface after the centrifugal spinning.

* * * * *